US006637114B2

(12) United States Patent
Moser et al.

(10) Patent No.: US 6,637,114 B2
(45) Date of Patent: Oct. 28, 2003

(54) SHAVING APPARATUS WITH AN UPPER CUTTER WITH CHARACTERISTICS FOR INFORMATION PURPOSES

(75) Inventors: Wolfgang Moser, Klagenfurt (AT); Peter Malobabic, Klagenfurt (AT); Alice Lauer, Pörtschach (AT); Nikolaus Knoflacher, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 35 days.

(21) Appl. No.: 10/084,720

(22) Filed: Feb. 25, 2002

(65) Prior Publication Data

US 2002/0116823 A1 Aug. 29, 2002

(30) Foreign Application Priority Data

Feb. 27, 2001 (EP) ..... 01890052

(51) Int. Cl.[7] ..... B26B 19/04
(52) U.S. Cl. ..... 30/43.92; 30/346.51
(58) Field of Search ..... 30/32, 34.05, 34.1, 30/43.9, 43.92, 346.51, 43, 43.2

(56) References Cited

U.S. PATENT DOCUMENTS

| | | | | | |
|---|---|---|---|---|---|
| 3,138,866 | A | * | 6/1964 | Ressler | 30/346.51 |
| 4,133,103 | A | * | 1/1979 | Beck | 30/346.51 |
| 5,459,927 | A | | 10/1995 | Kauer et al. | 30/43.1 |
| 5,901,446 | A | * | 5/1999 | Szymansky | 30/43.92 |

FOREIGN PATENT DOCUMENTS

| | | |
|---|---|---|
| DE | 1179830 | 10/1964 |

* cited by examiner

*Primary Examiner*—Hwei-Siu Payer

(57) ABSTRACT

A shaving apparatus (1) with an upper cutter (11) which has at least one hole configuration (17, 18, 19) for co-operation with a lower cutter, and with information indicia (16) which are formed by characteristics (20, 21, 22) which are associated with a respective hole configuration (17, 18, 19) and provide information on the function of the hole configuration (17, 18, 19) concerned, is structured such that the characteristic (20, 21, 22) associated with a hole configuration (17, 18, 19) is provided directly in the area of the hole configuration (17, 18, 19) and hence on the upper cutter (11) with the hole configuration (17, 18, 19).

12 Claims, 2 Drawing Sheets

SHAVING APPARATUS WITH AN UPPER CUTTER WITH CHARACTERISTICS FOR INFORMATION PURPOSES

The invention relates to a shaving apparatus with a drivable lower cutter with which any one of at least two hole configurations with different functions can be brought into active connection, said at least two hole configurations being constituents of at least one upper cutter for the shaving apparatus, and with information means which are formed by characteristics which are associated with a respective hole configuration, provide information on the function of the hole configuration concerned, and can inform a user of the shaving apparatus as to which hole configuration is actively connected to the lower cutter.

The invention also relates to an upper cutter for a shaving apparatus, which upper cutter has at least one hole configuration with a particular function.

A shaving apparatus of the kind set forth in the first paragraph and having an upper cutter of the kind set forth in the second paragraph has been marketed by Applicant as a type HP 6320 and is, therefore, known. The known shaver comprises an upper cutter in the form of a perforated cutter foil which has two different hole configurations intended for different functions, that is, for shaving different parts of a human body. In the known shaver the perforated cutter foil is held adjustably in the shaver; on one side wall of the shaver there is provided a slide button via which one of the two hole configurations can be selectably brought into active connection with the lower cutter of the known shaver. The known shaver is provided, immediately next to the slide button on the housing, with two visually perceptible symbols which serve as information means which symbolize those body areas which should be shaved using the hole configuration of the perforated cutter foil provided for this purpose. The information means, i.e. in this case the symbols, are thus provided at the area of the shaver housing of the known shaver. In practice it has been found that relatively many female users of the known shaver pay little or no attention to the symbols provided at the area of the shaver housing, with the consequence that users of the known shaver perform a shaving process using a hole configuration in a body area for which the hole configuration selected via the slide button was not intended and, consequently, is not suitable. This may lead to undesirable consequences, for example, an unsatisfactory shaving result or undesirable skin irritation.

In connection with the above known device, reference can also be made to patent document U.S. Pat. No. 5,459,927 A in which, however, the above symbols, provided next to the said slide button at the area of the shaver housing, are not discussed.

Furthermore, with regard to information means for information on a hole configuration in use, reference can also be made to patent document DE 1 179 830 B1. This patent document describes information means which are also provided at the area of a housing wall of the shaver housing and are formed by legible markings which also constitute characteristics for information on the function of hole configurations.

It is an object of the invention to eliminate the problems occurring with the known shaver as described above and to provide an improved shaving apparatus. The invention also has for its object to provide an upper cutter improved in this respect for a shaver.

In order to achieve the above object, a shaving apparatus according to the invention is provided with features such that a shaving apparatus according to the invention can be characterized as follows:

A shaving apparatus with a drivable lower cutter with which any one of at least two hole configurations with different functions can be brought into active connection, said at least two hole configurations being constituents of at least one upper cutter for the shaving apparatus, and with information means which are formed by characteristics which are associated with a respective hole configuration, provide information on the function of the hole configuration concerned, and can inform a user of the shaving apparatus as to which hole configuration is actively connected to the lower cutter, the characteristic associated with a hole configuration being provided immediately in the area of the hole configuration and hence on the upper cutter with the hole configuration.

To achieve the above object furthermore, an upper cutter according to the invention is provided with features according to the invention such that an upper cutter according to the invention can be characterized as follows:

An upper cutter for a shaving apparatus, which upper cutter has at least one hole configuration with a particular function, the upper cutter being provided for each hole configuration, with a characteristic symbolizing the function of the hole configuration.

By providing the features according to the invention, the characteristics serving as information means are provided on a shaver according to the invention in a simple manner and with simple means, that is, at that point of the shaver which is checked most frequently and most reliably by a user when selecting a desired hole configuration, that is, at the area of the hole configuration selected for the subsequent use itself. Thus, an incorrect choice of a hole configuration is very likely prevented, so that the disadvantages of the choice of an undesirable and hence unsuitable hole configuration are avoided.

A shaving apparatus according to the invention can be constructed so that one of several different upper cutters can be connected to this apparatus at option, each upper cutter having only a single hole configuration and hence only one function which is determined by the hole configuration concerned and hence only one perceptible characteristic associated with the hole configuration concerned as the information means. Such an upper cutter can, for example, be formed by a perforated cutter foil. It can, however, also be formed by a cutter plate with hair passage openings; this cutter plate can be designed for co-operation with a lower cutter which can be driven so as to rotate about an axis as is known from so-called rotary shavers which have been marketed by Applicant for decades. For a shaver according to the invention, however, it has proved to be very advantageous if the upper cutter is adjustably retained in known manner relative to the lower cutter and has at least two hole configurations, and if the upper cutter is provided with a number of characteristics acting as information means, which is equal to the number of hole configurations. Such a design has proved to be particularly advantageous in view of maximum simplicity of use and also of safely informing the user of the hole configuration concerned.

For an apparatus according to the invention it has also proved to be particularly advantageous if the upper cutter has three hole configurations, one of which is provided and designed for shaving in the armpit area, a second for shaving in the bikini area and a third for shaving in the leg area, and if the characteristics associated with the three hole configurations are parts of a diagram representing a human body. This ensures particularly easily understood and unmistakable information for the user.

In view of the choice of possible characteristics as information means it should be noted, however, that instead of a diagram showing the human body, other visually perceptible symbols can be used, for example, individual letters or word abbreviations but also a marking as known from the cited patent document DE 1 179 830 B1. However, characteristics perceptible with other sensory organs can also be used.

For a shaver according to the invention a design can be selected such that the characteristic associated with a hole configuration is provided next to the hole configuration on the upper cutter concerned. It has, however, proved to be particularly advantageous if the characteristic associated with a hole configuration is provided within the hole configuration. This offers the advantage that, for example, a visually perceptible characteristic for a hole configuration particularly clearly catches the eye of the user when looking at the hole configuration selected.

For a shaver according to the invention a visually perceptible characteristic can be provided on an upper cutter in various ways. It has, however, proved to be particularly advantageous if the characteristics are produced by printing on or etching of the upper cutter.

The advantages listed above in connection with a shaver apply accordingly for the various alternative embodiments of an upper cutter according to the invention.

The aspects listed above and further aspects of the invention will become apparent from the embodiments described hereinafter and will be explained on the basis thereof.

The invention will now be described with reference to two embodiments which are shown in the drawings, however, without the invention being restricted thereto in any way.

Figure 1:
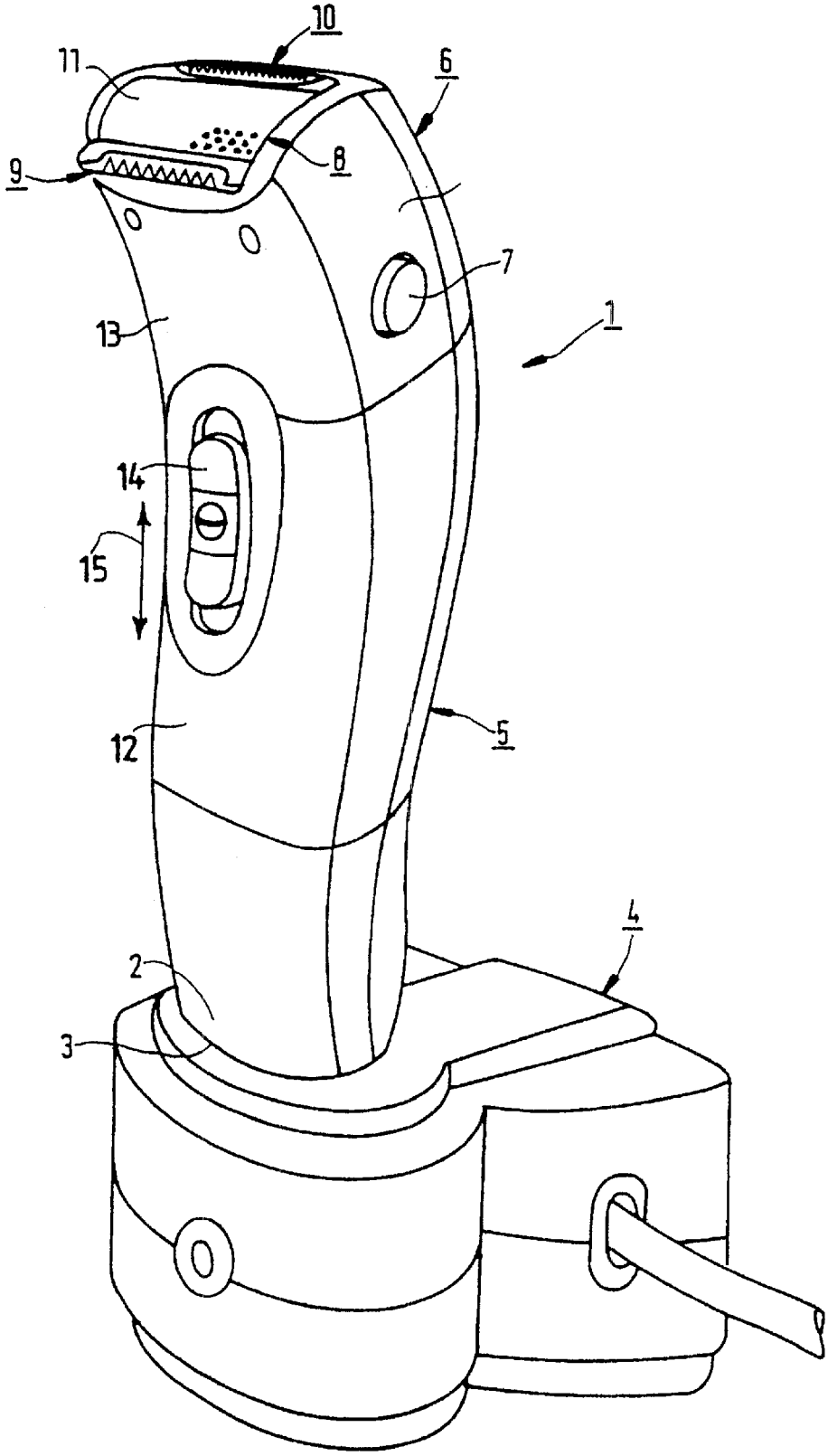
FIG. 1 is an oblique view from above of an embodiment of a shaving apparatus according to the invention inserted in a charger.

FIG. 1 shows a shaving apparatus 1 which is a lady's shaver. The shaver 1 is inserted with its base 2 in a receiving space 3 of a charger 4 in order to charge the accumulators fitted in the shaver 1.

The shaver 1 has a housing 5 which follows a slightly curved course. On the housing 5 there is provided a cutter head 6 which is releasably attached to the housing 5 by way of clip devices not shown. To release the clip devices, the cutter head frame 6 is provided on its two opposing narrow sides, with two push buttons 7, only one of which can be seen in FIG. 1. In the cutter head frame 6 there are provided a so-called short hair trimmer 8 and two long hair trimmers 9 and 10. The short hair trimmer 8 has a lower cutter which is not visible in FIG. 1 and is formed in known manner as a multiblade cutter and hence has a multiplicity of blades or cutters. The short hair trimmer 8 also has a foil-like upper cutter 11 which is referred to below as the perforated cutter foil 11. The perforated cutter foil 11 in the present case has three hole configurations, each of which fulfils or has a different function and can be brought into active connection with the lower cutter not shown. The hole configurations are thus elements of the perforated cutter foil 11. The perforated cutter foil 11 and its three hole configurations will be described in more detail with reference to the FIGS. 2, 3, 4 and 5.

It should be noted that the two long hair trimmers 9 and 10 are formed in known manner by so-called toothed cutters. The first long hair trimmer 9 is held non-adjustably in relation to the cutter head frame 6 and the second long hair trimmer 10 is held adjustably relative to the cutter head frame, so that it can be pushed out of the cutter head frame 6 opposite the position shown in FIG. 1. The means for adjustment of the second long hair trimmer 10 are not described in detail herein.

As already mentioned above, optionally one of the total of three hole configurations of the perforated cutter foil 11 can be brought into active connection with the lower cutter not shown. To achieve this, the shaver 1 is provided, at the area of a front wall 12 of the housing 5 and at the area of a front wall 13 of the cutter head frame 6, with a handle 14, that is, a slide button 14 which is adjustable between three button positions parallel to an adjustment direction indicated by double arrow 15. The slide button 14 is coupled, via an adjustment mechanism not shown, to the perforated cutter foil 11 so that the perforated cutter foil 11 is adjustable, that is, it can follow a curved course determined by the course of the blades or cutters of the lower cutter.

The shaver 1 is provided with information means 16 which are not, however, shown in FIG. 1. Reference is made to the FIGS. 2, 3, 4 and 5 for these information means 16.

Figure 2:
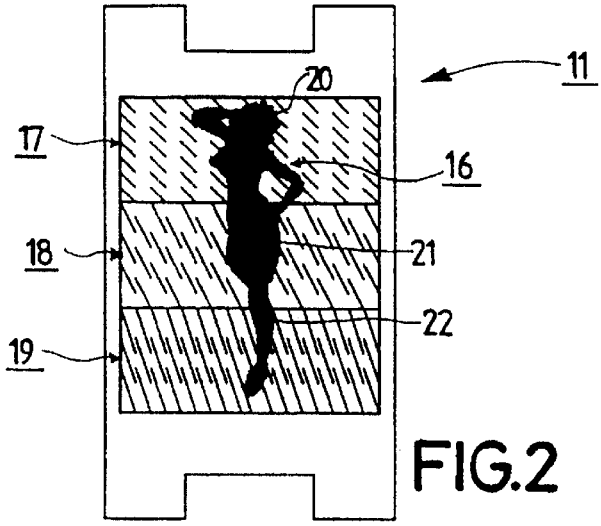
FIG. 2 is a plan view of a first embodiment a perforated cutter foil according to the invention intended as an upper cutter for the shaving apparatus according to FIG. 1, said perforated cutter foil being provided with three hole configurations.

FIG. 2 shows diagrammatically the perforated cutter foil 11 of the shaver 1 according to FIG. 1. The perforated cutter foil 11 has three hole configurations 17, 18 and 19. The first hole configuration 17 is provided and designed for shaving the armpit area, the second hole configuration 18 for shaving the bikini area, i.e. the pubic area, and the third hole configuration 19 for shaving the leg area. In other words, the geometry of the holes and the size of the holes and the number of the holes in each of the three hole configurations 17, 18 and 19 are selected according to the required function, i.e. according to the required shaving behaviour in the body area concerned, for which the corresponding hole configurations 17, 18 and 19 are provided.

As already stated above, the shaver 1 is provided with information means 16. The information means 16 in this case formed by characteristics 20, 21, 22 which are associated with each hole configuration 17, 18 and 19 and provide information on the function of the hole configuration concerned; via these characteristics a user of the shaver 1 is informed as to which hole configuration of the total of three hole configurations 17, 18 and 19 is actively connected to the lower cutter (not shown) of the shaver 1. In the present case there is a particularly advantageous structure such that the characteristic 20, 21 or 22 associated with a hole configuration 17,18 or 19 is provided immediately in the vicinity of the hole configuration 17, 18 or 19 concerned and, consequently, on the perforated cutter foil 11 which has the relevant hole configuration 17, 18, 19 and is provided as an upper cutter. The number of characteristics 20, 21 and 22 is the same as the number of hole configurations 17, 18 and 19, so that the perforated cutter foil 11 has a number of characteristics 20, 21 and 22 serving as information means 16 which is equal to the number of hole configurations 17, 18 and 19.

For the perforated cutter foil 11 according to FIG. 2 the characteristics 20, 21 and 22 associated with the three hole configurations 17, 18 and 19 are parts of a diagram representing a human body, in the present case being the diagram of the body of a female user. The diagram acting as the information means 16 is structured such that the diagram provides a clear reference to the armpit area, the bikini area and the leg areas.

Figure 3:
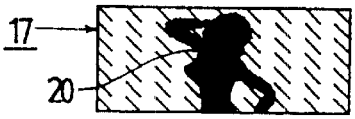
FIG. 3 is a view obtained when viewing the perforated cutter foil provided in the shaver according to FIG. 1 when the first hole configuration is selected for co-operation with the lower cutter of the shaver.
Figure 4:
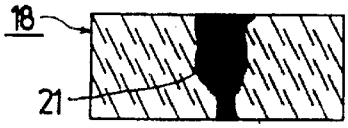
FIG. 4 is a view, similar to that of FIG. 3, obtained when viewing the perforated cutter foil provided in the shaver according to FIG. 1 when the second hole configuration is selected for co-operation with the lower cutter of the shaver.
Figure 5:
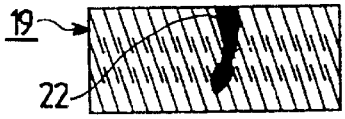
FIG. 5 is a view, similar to that of the FIGS. 3 and 4, obtained when viewing the perforated cutter foil provided in the shaver according to FIG. 1 when the third hole configuration is selected for co-operation with the lower cutter of the shaver.

FIGS. 3 to 5 show those views or situations which are visually perceptible by a user when one of the three hole configurations 17, 18 and 19 is actively connected to the lower cutter of the shaver 1. In the situation shown in FIG. 3 the first hole configuration 17, intended for shaving the armpit area, is actively connected to the lower cutter of the shaver 1 according to FIG. 1. In the situation shown in FIG. 4 the second hole configuration 18, intended for shaving the bikini area, is actively connected to the lower cutter of the shaver 1 according to FIG. 1. In the situation shown in FIG. 5 the hole configuration 19, intended for shaving in the leg area, is actively connected to the lower cutter of the shaver 1 according to FIG. 1. As is clear from the FIGS. 3, 4 and 5, the characteristics 20, 21 and 22 of the information means 16 provide a clear reference to the respective hole configuration 17, 18 and 19 brought into active connection with the lower cutter of the shaver 1, so that incorrect and undesirable use of a hole configuration 17, 18 or 19 is practically precluded in the shaver 1 according to FIG. 1.

Figure 6:
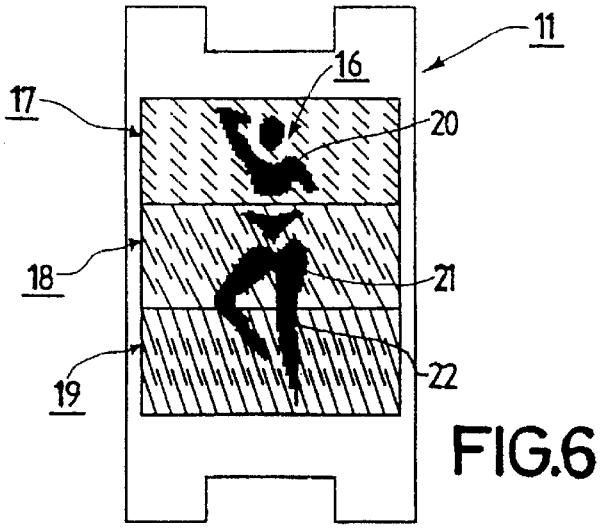
FIG. 6 is a view, similar to that of FIG. 2, of a second embodiment of a perforated cutter foil according to the invention.

FIG. 6 shows a perforated cutter foil 11 according to a second embodiment of the invention. The design of the perforated cutter foil 11 according to FIG. 6 differs from the design of the perforated cutter foil 11 according to FIG. 2 essentially in that the diagram representing the human body of a female user is shown less naturally but more diagrammatically, thus enhancing the clarity of the reference to the body area to be shaved.

For the perforated cutter foil 11 according to FIG. 2 the three characteristics 20, 21 and 22 associated with the hole configurations 17, 18 and 19, together forming a diagram of the human body of a female user, are produced by printing on the perforated cutter foil. For the perforated cutter foil 11 according to FIG. 6 this is achieved by etching the perforated cutter foil 11.

It should be noted here that the characteristic associated with a hole configuration of an upper cutter (which need not necessarily be a perforated cutter foil) need not necessarily be formed by part of a diagram showing a human body. Instead of such a rather symbolic characteristic, a marking can be provided in the form of a text; such a text may consist of the name the body area to be shaved, but also of an abbreviation of the name of this body area or by simply of the initial letters for these body areas.

It should also be noted that a characteristic need not necessarily consist of a visually perceptible marking, but may also consist of a marking which can be sensed by the fingertips or a marking which is perceptible by the sense of smell or taste; this is of particular importance if a shaver according to the invention and an upper cutter according to the invention are to be designed advantageously for blind users. For example, an upper cutter can be provided with at least one reservoir for a fragrance.

What is claimed is:

1. A shaving apparatus (1) with a drivable lower cutter with which any one of at least two hole configurations (17, 18, 19) with different functions can be brought into active connection, said at least two hole configurations (17, 18, 19) being constituents of at least one upper cutter (11) for the shaving apparatus (1), and with information means (16) which are formed by characteristics (20, 21, 22) which are associated with a respective hole configuration (17, 18, 19), provide information on the function of the hole configuration (17, 18, 19) concerned, and can inform a user of the shaving apparatus (1) as to which hole configuration (17, 18, 19) is actively connected to the lower cutter, the characteristic (20, 21, 22) associated with a hole configuration (17, 18, 19) being provided immediately in the area of the hole configuration (17, 18, 19) and hence on the upper cutter (11) with the hole configuration (17, 18, 19).

2. A shaving apparatus (1) as claimed in claim 1, wherein the upper cutter (11) is adjustably fitted relative to the lower cutter and has at least two hole configurations (17,18, 19), and wherein the upper cutter (11) is fitted with a number of characteristics (20, 21, 22), acting as information means (16), which is equal to its number of hole configurations (17, 18, 19).

3. A shaving apparatus (1) as claimed in claim 2, wherein the upper cutter (11) has three hole configurations (17, 18, 19), a first hole configuration (17) being intended and designed for shaving armpit area, a second hole configuration (18) for shaving bikini area, and a third hole configuration (19) for shaving leg area, and wherein the characteristics (20, 21, 22) associated with the three hole configurations (17, 18, 19) are parts of diagram depicting a human body.

4. A shaving apparatus (1) as claimed in claim 1, wherein the characteristic (20, 21, 22) associated with a hole configuration (17, 18, 19) is provided within the hole configuration (17, 18, 19).

5. A shaving apparatus (1) as claimed in claim 1, wherein the characteristics (20, 21, 22) are realized by printing on the upper cutter (11).

6. A shaving apparatus (1) as claimed in claim 1, wherein the characteristics (20, 21, 22) are realized by etching the upper cutter (11).

7. An upper cutter (11) for a shaving apparatus (1), which upper cutter (11) has at least one hole configuration (17, 18, 19) with a particular function, the upper cutter (11) being provided, for each hole configuration (17, 18, 19), with a characteristic (20, 21, 22) symbolizing the function of the hole configuration (17, 18, 19).

8. An upper cutter (11) as claimed in claim 7, which upper cutter (11) has at least two hole configurations (17, 18, 19) and the number of characteristics (20, 21, 22), acting as information means (16), is equal to the number of hole configurations (17, 18, 19) of the upper cutter (11).

9. An upper cutter (11) as claimed in claim 8, which upper cutter (11) has three hole configurations (17, 18, 19), a first hole configuration (17) being intended and designed for shaving armpit area, a second hole configuration (18) for shaving bikini area, and a third hole configuration (19) for shaving leg area and the characteristics (20, 21, 22) associated with the three hole configurations (17, 18, 19) being parts of diagram depicting a human body.

10. An upper cutter (11) as claimed in claim 7, the characteristic (20, 21, 22) associated with a hole configuration (17, 18, 19) being provided within the hole configuration (17, 18, 19).

11. An upper cutter (11) as claimed in claim 7, the characteristics (20, 21, 22) being realized by printing on the upper cutter (11).

12. An upper cutter (11) as claimed in claim 7, the characteristics (20, 21, 22) being realized by etching the upper cutter (11).

* * * * *